US008973552B2

(12) United States Patent
Horn

(10) Patent No.: US 8,973,552 B2
(45) Date of Patent: Mar. 10, 2015

(54) INTEGRAL OIL SYSTEM

(75) Inventor: Mark D. Horn, Granada Hills, CA (US)

(73) Assignee: United Technologies Corporation, Hartford, CT (US)

( * ) Notice: Subject to any disclaimer, the term of this patent is extended or adjusted under 35 U.S.C. 154(b) by 775 days.

(21) Appl. No.: 13/169,401

(22) Filed: Jun. 27, 2011

(65) Prior Publication Data

US 2012/0325176 A1 Dec. 27, 2012

(51) Int. Cl.

| | |
|---|---|
| ***F02B 53/00*** | (2006.01) |
| ***F02G 3/00*** | (2006.01) |
| ***F02K 99/00*** | (2009.01) |
| ***F02B 53/04*** | (2006.01) |
| ***F02B 53/08*** | (2006.01) |
| ***F01M 5/00*** | (2006.01) |

(52) U.S. Cl.
CPC ..... *F01M 5/002* (2013.01)
USPC ..... 123/200; 60/39.08; 60/266; 60/267; 60/226.1; 123/221; 123/224

(58) Field of Classification Search
USPC ..... 123/200, 234, 221, 224; 60/39.08, 645, 60/266, 267, 226.1
See application file for complete search history.

(56) References Cited

U.S. PATENT DOCUMENTS

| | | | | | |
|---|---|---|---|---|---|
| 2,268,183 | A | | 12/1941 | Buatti | |
| 2,524,066 | A | * | 10/1950 | Andersen | 62/241 |
| 2,593,541 | A | | 4/1951 | Cowdrey et al. | |
| 2,731,239 | A | * | 1/1956 | Andersen | 165/299 |
| 3,212,262 | A | * | 10/1965 | Pedrick | 60/39.38 |
| 3,266,564 | A | * | 8/1966 | Sabatiuk | 165/86 |
| 3,539,009 | A | * | 11/1970 | Kudlaty | 210/90 |
| 3,687,233 | A | | 8/1972 | Greenwald | |
| 3,756,020 | A | * | 9/1973 | Moskowitz et al. | 60/760 |
| 3,783,615 | A | * | 1/1974 | Hubers | 123/213 |
| 3,797,561 | A | * | 3/1974 | Clark et al. | 60/39.08 |
| 3,896,875 | A | * | 7/1975 | Bolger | 165/86 |
| 3,901,034 | A | * | 8/1975 | Munzinger | 60/519 |
| 3,945,200 | A | * | 3/1976 | Wright | 60/624 |
| 3,964,445 | A | | 6/1976 | Ernest et al. | |
| 3,978,660 | A | * | 9/1976 | Laing | 60/39.511 |
| 4,020,632 | A | * | 5/1977 | Coffinberry et al. | 60/773 |
| 4,035,112 | A | * | 7/1977 | Hackbarth et al. | 418/60 |
| 4,125,345 | A | * | 11/1978 | Yoshinaga et al. | 417/243 |
| 4,151,710 | A | * | 5/1979 | Griffin et al. | 60/39.08 |
| 4,237,848 | A | | 12/1980 | Korzhov et al. | |
| 4,773,212 | A | * | 9/1988 | Griffin et al. | 60/772 |
| 4,887,424 | A | | 12/1989 | Geidel et al. | |
| 4,999,994 | A | | 3/1991 | Rud et al. | |
| 5,317,877 | A | * | 6/1994 | Stuart | 60/736 |
| 5,544,700 | A | * | 8/1996 | Shagoury | 165/139 |

(Continued)

FOREIGN PATENT DOCUMENTS

| | | | | |
|---|---|---|---|---|
| JP | 55001415 | | 1/1980 | |
| WO | WO 9015918 | A1 * | 12/1990 | F01B 13/06 |

OTHER PUBLICATIONS

US 3,569,562, 1/1971, Jones, Charles (withdrawn).*

*Primary Examiner* — Thomas Denion
*Assistant Examiner* — Jessica Kebea
(74) *Attorney, Agent, or Firm* — Carlson, Gaskey & Olds P.C.

(57) ABSTRACT

An oil management system includes an engine housing assembly which defines a first rotor volume and a second rotor volume. An oil cooler assembly arranged between the first rotor volume and the second rotor volume.

14 Claims, 6 Drawing Sheets

(56) References Cited

U.S. PATENT DOCUMENTS

| | | | | |
|---|---|---|---|---|
| 5,987,877 | A | 11/1999 | Steiner | |
| 6,092,360 | A | 7/2000 | Hoag et al. | |
| 6,241,497 | B1 * | 6/2001 | Mallen | 418/142 |
| 6,282,881 | B1 | 9/2001 | Beutin et al. | |
| 6,295,803 | B1 * | 10/2001 | Bancalari | 60/39.511 |
| 6,510,684 | B2 * | 1/2003 | Matsunaga | 60/39.511 |
| 6,651,929 | B2 | 11/2003 | Dionne | |
| 6,672,075 | B1 * | 1/2004 | Sandu et al. | 60/806 |
| 6,901,737 | B2 | 6/2005 | Schnoor | |
| 6,931,834 | B2 | 8/2005 | Jones | |
| 6,942,181 | B2 | 9/2005 | Dionne | |
| 7,213,391 | B2 | 5/2007 | Jones | |
| 7,231,767 | B2 | 6/2007 | Whiting | |
| 7,364,117 | B2 | 4/2008 | Dionne | |
| 7,454,894 | B2 | 11/2008 | Larkin et al. | |
| 7,578,369 | B2 | 8/2009 | Francisco et al. | |
| 7,765,788 | B2 | 8/2010 | Schwarz | |
| 7,810,311 | B2 | 10/2010 | Schwarz et al. | |
| 2003/0099538 | A1 * | 5/2003 | Liu | 415/1 |
| 2005/0188943 | A1 * | 9/2005 | Gonzalez et al. | 123/245 |
| 2006/0196464 | A1 * | 9/2006 | Conners | 123/204 |
| 2009/0097972 | A1 * | 4/2009 | Murphy | 415/178 |
| 2011/0197849 | A1 * | 8/2011 | Wright | 123/241 |
| 2012/0107104 | A1 * | 5/2012 | Suciu et al. | 415/177 |

* cited by examiner

INTEGRAL OIL SYSTEM

BACKGROUND

The present disclosure relates to an oil management system and more particularly to an integrated oil system.

Engine oil management systems are typically either a wet-sump or dry-sump arrangements. In a dry-sump system, the oil is contained in a separate tank, and circulated through the engine by pumps. In a wet-sump system, the oil is located in a sump, which is an integral part of the engine.

A main component of a wet-sump system is an oil pump, which draws oil from the sump and routes it to the engine. After the oil passes through the engine, it returns to the sump. An oil pump also supplies oil pressure in a dry-sump system, but the source of the oil is a separate oil tank, located external to the engine. After oil is routed through the engine, it is pumped from the various locations in the engine back to the oil tank by scavenge pumps. Dry sump systems allow for a greater volume of oil to be supplied to the engine, which are suitable for engines such as an aircraft in a pusher configuration.

BRIEF DESCRIPTION OF THE DRAWINGS

Various features will become apparent to those skilled in the art from the following detailed description of the disclosed non-limiting embodiment. The drawings that accompany the detailed description can be briefly described as follows.

DETAILED DESCRIPTION

Figure 1:
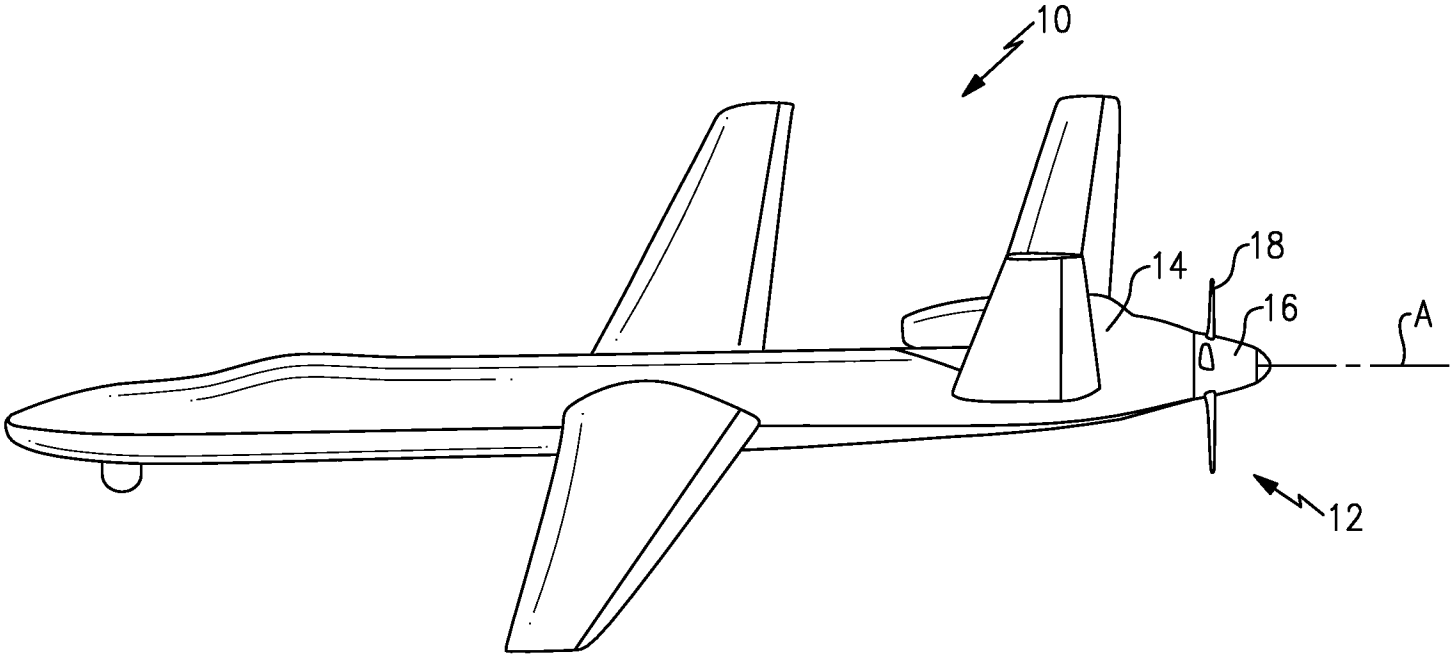
FIG. 1 is a general perspective view of an exemplary aircraft embodiment for use with the present disclosure.

FIG. 1 schematically illustrates an air vehicle 10 with a pusher prop propulsion system 12. The pusher prop propulsion system 12 generally includes an engine 14 which drives a rotor hub 16 with a multiple of prop blades 18 for rotation about an axis of rotation A. The rotor hub 16 may be driven directly by the engine 14 or through a geared architecture of various configurations. Although a propeller system typical of a fixed wing aircraft is illustrated in the disclosed non-limiting embodiment, it should be understood that various air vehicle, rotor blade and propeller system configurations will also benefit herefrom.

Figure 2:
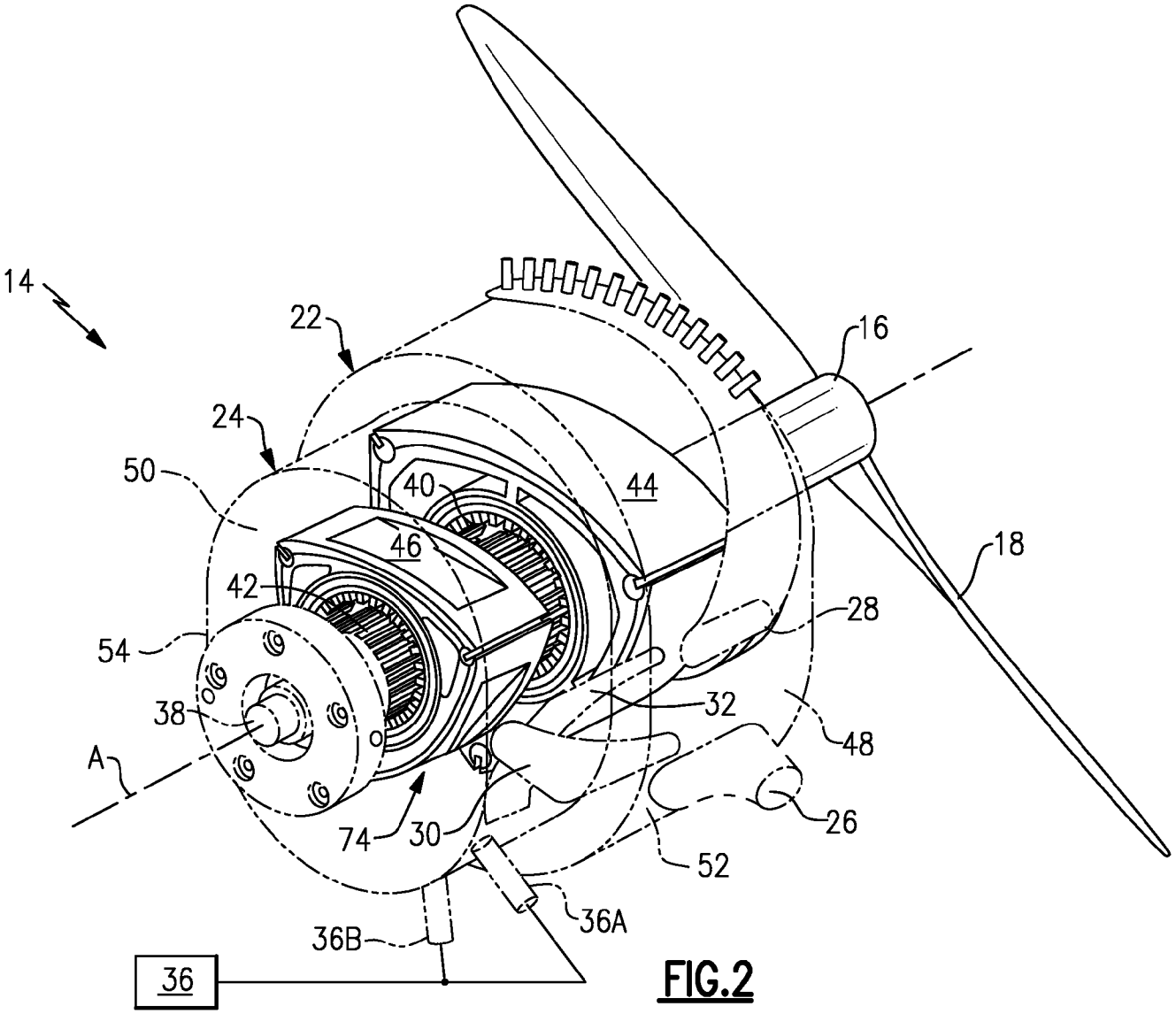
FIG. 2 is a schematic partial phantom view of an engine for use with the aircraft of FIG. 1.

With reference to FIG. 2, the engine 14 in the disclosed non-limiting embodiment is a rotary engine that includes a compression section 22 and a power section 24. Although a rotary engine is illustrated in the disclosed non-limiting embodiment, it should be understood that other engines such as gas turbine and internal combustion engines may alternatively benefit therefrom.

An intake port 26 communicates ambient air to the compression section 22 and an exhaust port 28 communicates exhaust products therefrom. A first transfer duct 30 and a second transfer duct 32 communicate between the compression section 22 and the power section 24 such that the exhaust of the power section 24 may be returned to the compression section 22 to provide power recovery and increasing efficiency which provides a cycle within what is referred to herein as a compound rotary engine of the Wankel-type that operates with a heavy fuel such as JP-8, JP-4, diesel or other.

A single shaft 38 which rotates about the axis of rotation A includes aligned eccentric cams 40, 42 which drive a respective first rotor 44 and second rotor 46 which are driven in a coordinated manner by the shaft 38. The first rotor 44 and second rotor 46 are respectively rotatable in volumes 48, 50 formed by a stationary first rotor housing 52 and a stationary second rotor housing 54. The surfaces of the volumes 48, 50 in planes normal to the axis of rotation A are substantially those of a two-lobed epitrochoid while the surfaces of the rotors 44, 46 in the same planes are generally a Reuleaux triangle which mates with the inner envelope of the two-lobed epitrochoid.

A fuel system 36 includes fuel injectors 36A, 36B in communication with the second rotor volume 50 generally opposite the side thereof where the transfer ducts 30, 32 are situated in one non-limiting embodiment. The fuel system 36 supplies fuel into the second rotor volume 50. The first rotor volume 48 in one non-limiting embodiment provides a greater volume than the second rotor volume 50. The first rotor housing 52 and the second rotor housing 54 may be formed in an independent or integral manner to define an engine housing assembly 56 with various fin type and other cooling features (FIG. 3).

In operation, air enters the engine 14 through the intake port 26. The first rotor 44 provides a first phase of compression and the first transfer duct 30 communicates the compressed air from the first rotor volume 48 to the second rotor volume 50. The second rotor 46 provides a second phase of compression, combustion and a first phase of expansion, then the second transfer duct 32 communicates the exhaust gases from the second rotor volume 50 to the first rotor volume 48. The first rotor 44 provides a second phase of expansion to the exhaust gases, and the expanded exhaust gases are expelled though the exhaust port 28. As each rotor face completes a cycle every revolution and there are two rotors with a total of six faces, the engine produces significant power within a relatively small displacement.

Figure 3:
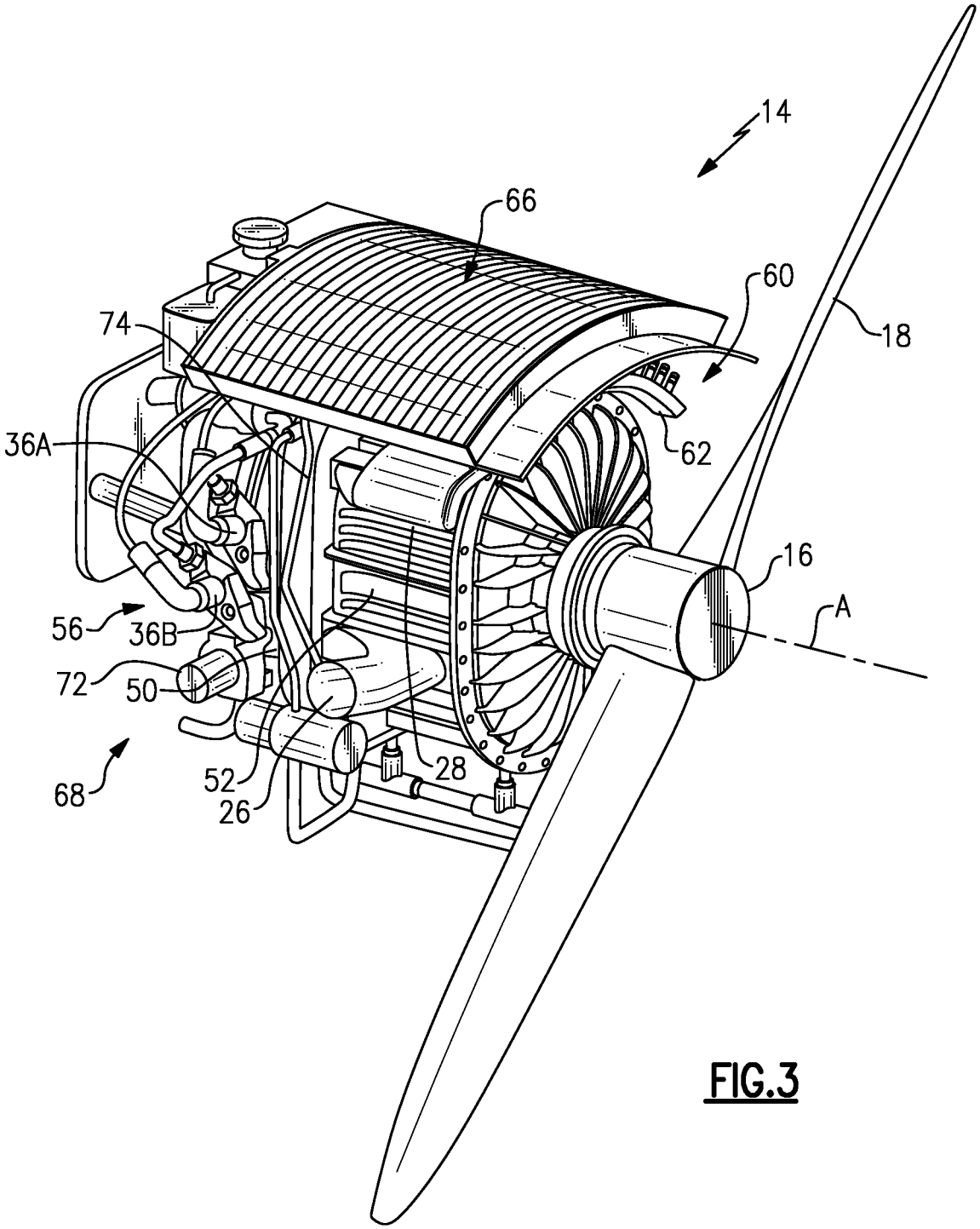
FIG. 3 is a perspective view of the engine.
Figure 4:
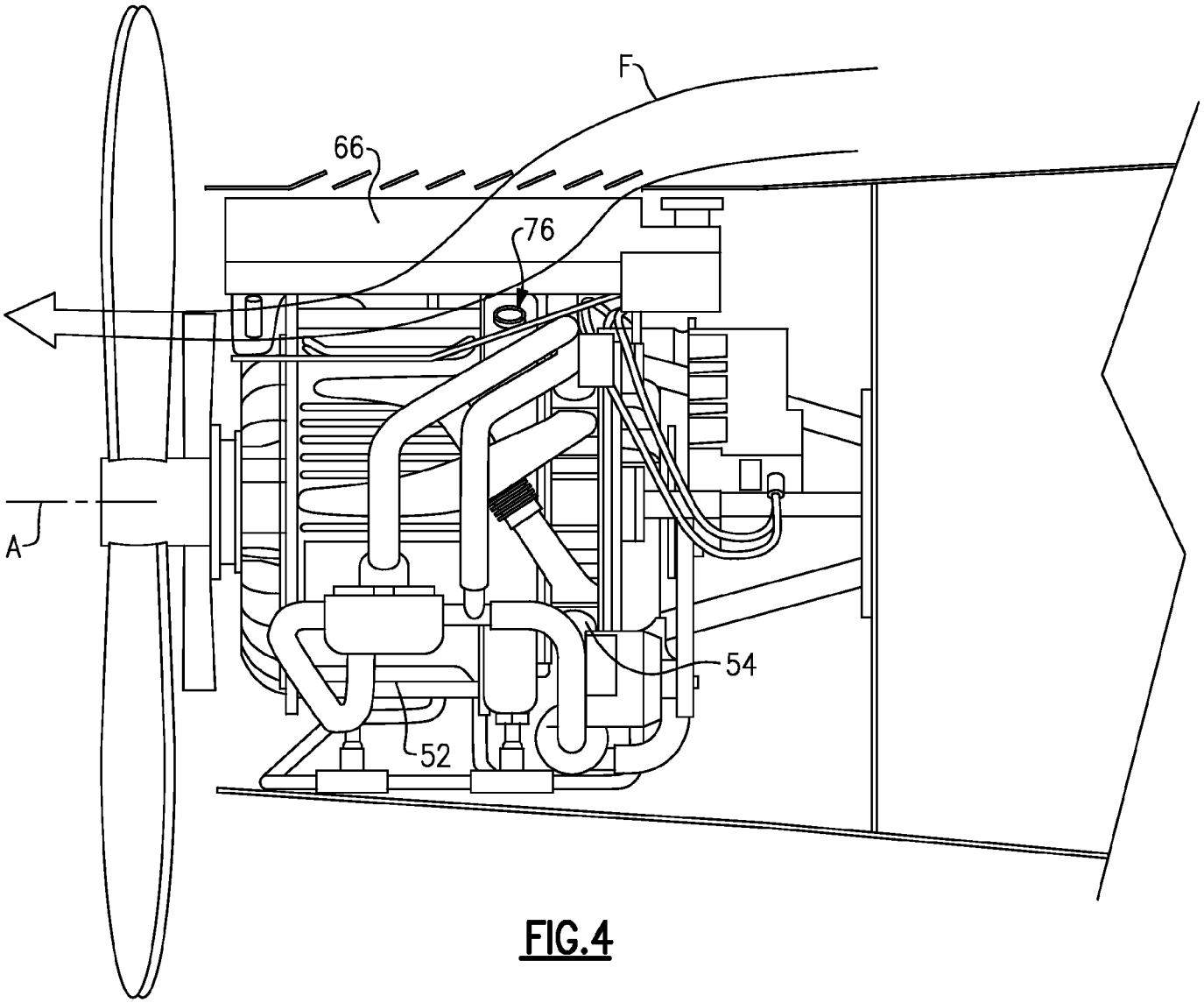
FIG. 4 is a side schematic view of the engine with an integral oil system in accords with one non-limiting embodiment.

With reference to FIG. 3, an exhaust system 60 may be arranged in conformal arrangement between the engine housing assembly 56 and an engine mounted conformal radiator 66. An oil management system 68 generally includes an oil pump 70, a water pump 72, and an oil cooler/filtration/dearation assembly 74. The oil cooler/filter/dearation assembly 74 may be arranged between the first rotor 44 and second rotor 46 of the respective compression section 22 and power section 24 generally between the first rotor housing 52 and the second rotor housing 54. The oil cooler assembly 74 also provides structural load carrying capability supporting the side walls of the engine housings on either side within a compact package that is light in weight due to integration with the engine housing assembly 56 which minimizes auxiliary components. (FIG. 4) It should be understood that various housing configurations which integrate the oil cooler assembly 74 may alternatively or additionally be provided.

Figure 5:
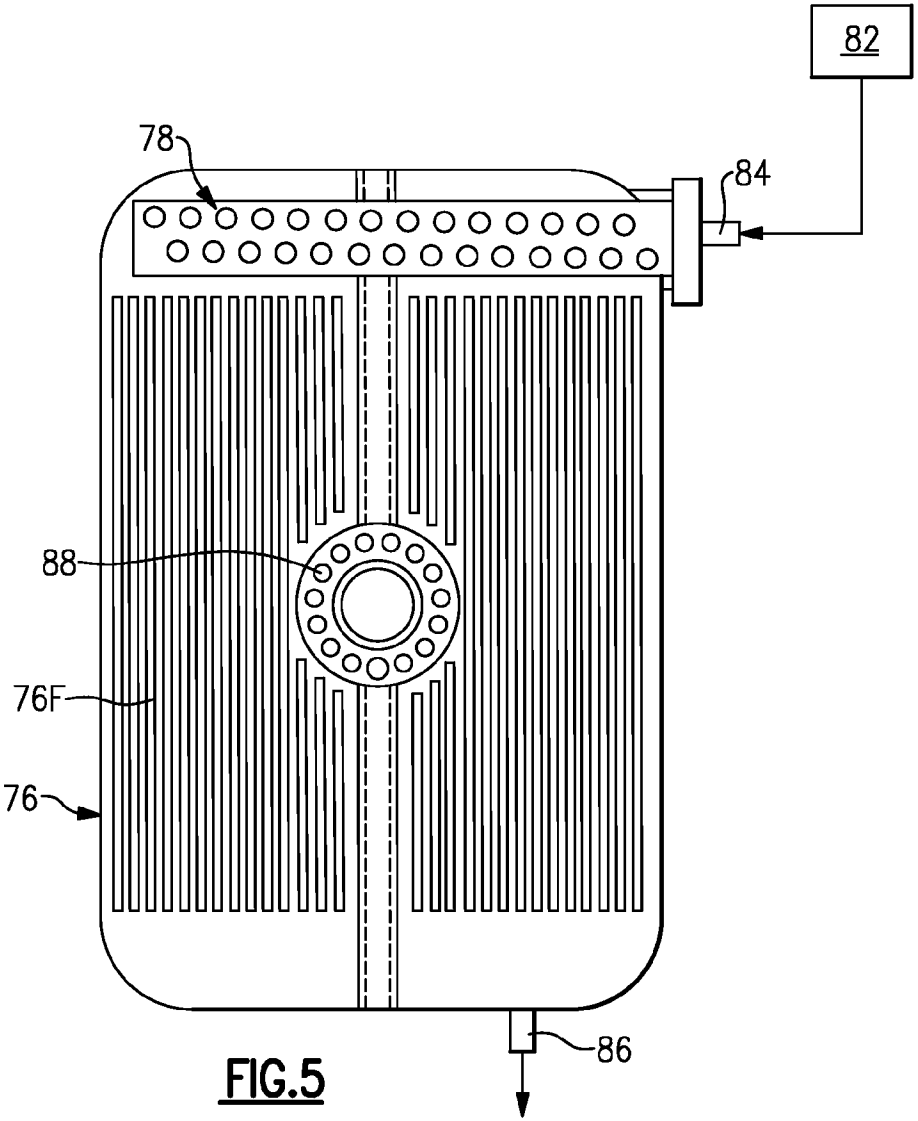
FIG. 5 is a section view of the engine through the integral oil system illustrating key oil system elements.

With reference to FIG. 5, the oil cooler assembly 74 includes an oil reservoir 76 that receives a replaceable oil filter 78. The oil reservoir 76 may be cooled by an engine coolant flow circuit 80, 88 (FIGS. 6, 7) which in the disclosed non-limiting embodiment is a water circuit (FIG. 5). Various coolant fins 76F (illustrated schematically) in thermal communication with the coolant flow circuit 80 are located within the oil reservoir 76. It should be understood that various passages and/or fins or various configurations may be provided. In another disclosed non-limiting embodiment, an air cooled system may additionally or alternatively be utilized.

The oil reservoir 76 receives oil from an oil circuit 82 (illustrated schematically) to provide a thermal transfer exchange with the coolant flow circuit 80. The oil circuit 82 may be used to cool various engine components, for example, bearing elements. The oil reservoir receives oil from the oil circuit 82 through an oil inlet 84 in communication with the oil filter 78 which is located above an oil discharge 86. The oil reservoir 76 in the disclosed non-limiting embodiment may be considered a dry sump system with the oil pump 70 and a secondary external oil reservoir (not shown) such that oil passage through the oil reservoir 76 facilitates separation or dearation of any entrained gases from the oil before reuse.

Figure 6:
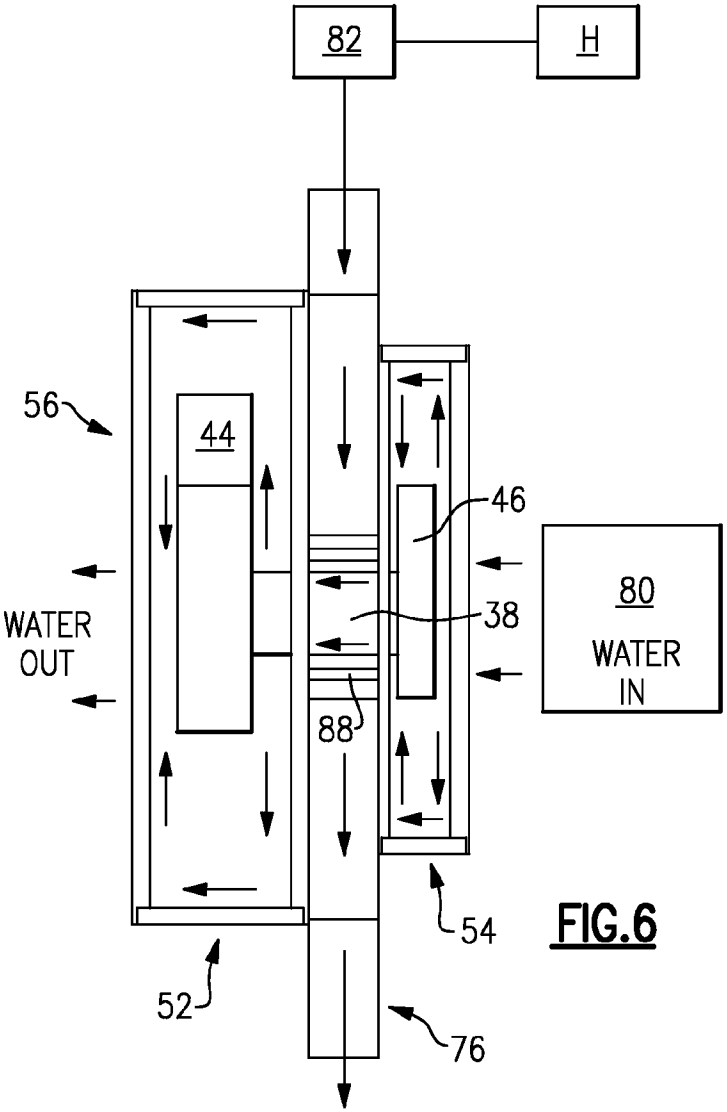
FIG. 6 is a side view schematic of the engine illustrating the location of the oiling system between the first and second rotor housing.

With reference to FIG. 6, the coolant flow circuit 80 is integral to the engine housing assembly 56 to cool the first rotor housing 52 and the second rotor housing 54. Between the first rotor housing 52 and the stationary second rotor housing 54, the coolant flow circuit 80 passes through the oil reservoir 76 in a multiple of passages 88 located in this non-limiting embodiment around the shaft 38. That is, the multiple of passages 88 are generally arranged in an annulus in thermal communication with the oil circuit 82. In addition, the coolant flow circuit 80 may be utilized to facilitate oil preheat with a selectively operable heater system H (illustrated schematically) in communication with the coolant flow circuit 80.

Figure 7:
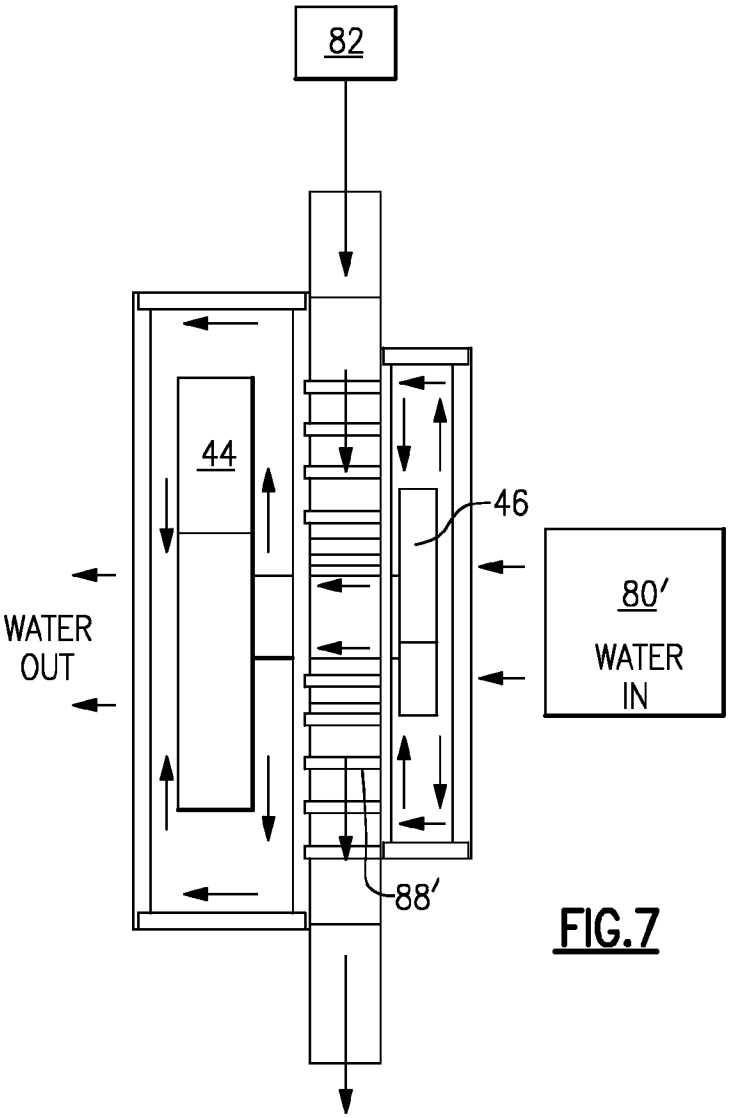
FIG. 7 is a side view with another non-limiting embodiment where water feed-throughs are distributed across the oil cooler.
Figure 8:
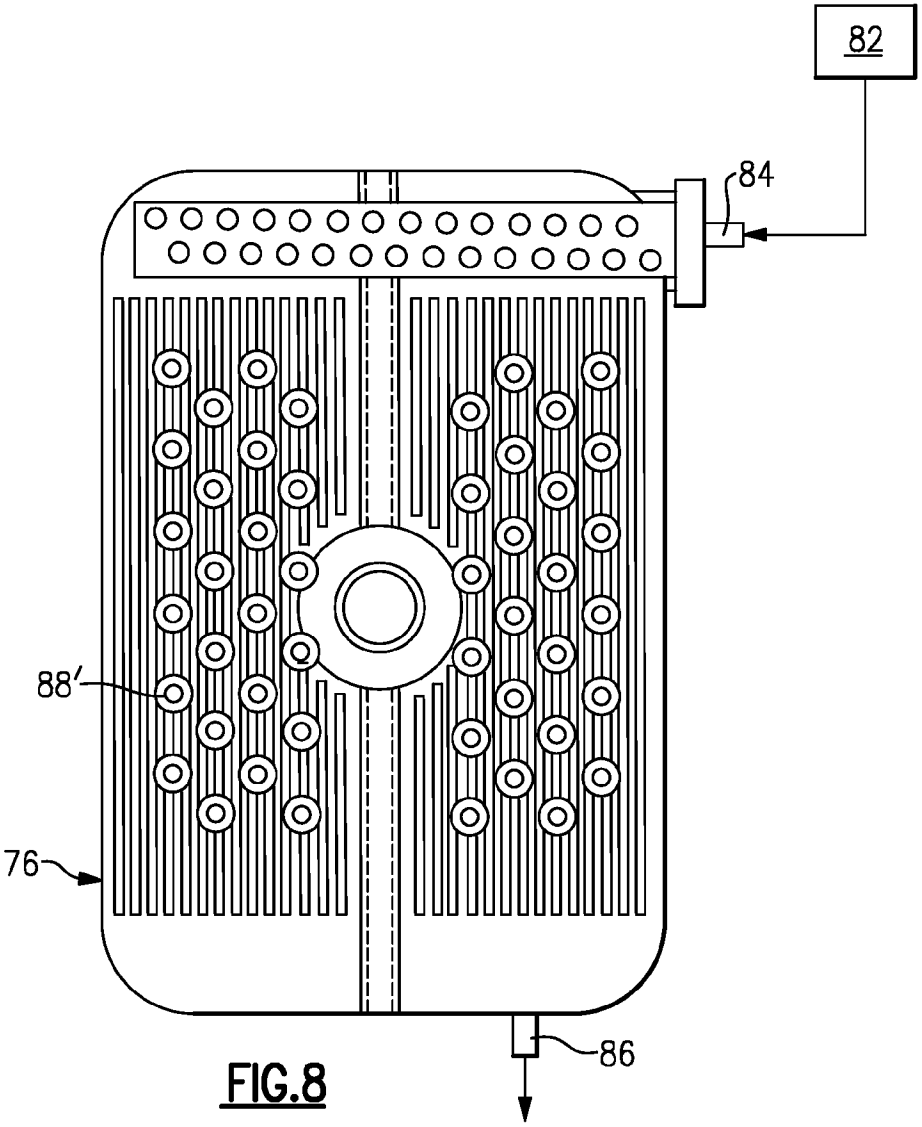
FIG. 8 is a section view of the of the integral oil system of the other non-limiting embodiment depicted in FIG. 7

With reference to FIG. 7, a coolant flow circuit 80' according to another non-limiting embodiment includes a multiple of passages 88' which extend through the oil reservoir 76 (FIG. 8). It should be understood that various passage arrangements may alternatively or additionally be provided.

It should be understood that relative positional terms such as "forward," "aft," "upper," "lower," "above," "below," and the like are with reference to the normal operational attitude of the vehicle and should not be considered otherwise limiting.

It should be understood that like reference numerals identify corresponding or similar elements throughout the several drawings. It should also be understood that although a particular component arrangement is disclosed in the illustrated embodiment, other arrangements will benefit herefrom.

Although particular step sequences are shown, described, and claimed, it should be understood that steps may be performed in any order, separated or combined unless otherwise indicated and will still benefit from the present disclosure.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be understood that within the scope of the appended claims, the disclosure may be practiced other than as specifically described. For that reason the appended claims should be studied to determine true scope and content.

What is claimed is:

1. An oil management system comprising:

an engine housing assembly which defines a first rotor housing and a second rotor housing;

the first rotor housing and the second rotor housing which define a first rotor volume and a second rotor volume, respectively;

an oil cooler assembly between said first rotor volume and said second rotor volume, said oil cooler assembly including an oil reservoir;

a coolant circuit in communication with said oil cooler assembly, said coolant circuit including at least one passage through said oil reservoir, said at least one passage is integral to the first rotor housing and the second rotor housing to fluidly connect the first rotor housing and the second rotor housing; and wherein water flows through said at least one passage.

2. The system as recited in claim 1, wherein said oil reservoir includes an oil filter.

3. The system as recited in claim 1, wherein a plurality of coolant fins are provided in said oil reservoir.

4. An engine comprising:

a compressor housing including a first rotor within a first rotor volume;

a power housing including a second rotor within a second rotor volume;

an oil cooler assembly between said compressor section and said power section, said oil cooler assembly including an oil reservoir;

a coolant circuit in communication with said oil cooler assembly, said coolant circuit including a plurality of passages through said oil reservoir, said plurality of passages are integral with the compressor housing and the power housing to fluidly connect the compressor housing and the power housing;

wherein said first rotor and said second rotor are mounted to a shaft; and wherein, in planes normal to an engine axis of rotation, surfaces of said first and second rotor volumes are substantially two-lobed epitrochoids.

5. The engine as recited in claim 4, wherein said engine is a rotary engine.

6. The engine as recited in claim 4, wherein said plurality of passages includes a plurality of first passages arranged circumferentially about said shaft.

7. The engine as recited in claim 6, wherein said plurality of passages includes a plurality of second passages spaced-apart from said plurality of first passages.

8. The engine as recited in claim 4, wherein first and second eccentric cams are mounted to said shaft, said first and second eccentric cams driving a respective one of said first and second rotors.

9. The engine as recited in claim 4, wherein water flows through said plurality of passages.

10. A pusher prop propulsion system comprising:

an engine defined along a propeller axis of rotation;

an engine housing assembly including a first rotor housing defining a first rotor volume and including a second rotor housing defining a second rotor volume;

an oil management system integral with said engine, said oil management system including an oil reservoir located within said engine housing assembly; and an engine coolant flow circuit in thermal communication with said oil management system, said engine coolant flow circuit including a plurality of passages through said oil reservoir, said plurality of passages are integral with the first rotor housing and the second rotor housing to fluidly connect the first rotor housing and the second rotor housing;

a first rotor within said first rotor volume and a second rotor within a second rotor volume, wherein said first rotor and said second rotor are mounted to a shaft along said propeller axis of rotation; and first and second eccentric cams mounted to said shaft, said first and second eccentric cams configured to drive a respective one of said first and second rotors.

11. The system as recited in claim 10, wherein said engine is a rotary engine.

12. The engine as recited in claim 10, further comprising a propeller driven by said engine.

13. The engine as recited in claim 10, wherein said oil reservoir includes an oil filter.

14. The system as recited in claim 10, wherein water flows through said plurality of passages.

* * * * *